United States Patent [19]

Yardley et al.

[11] Patent Number: 4,610,041

[45] Date of Patent: Sep. 9, 1986

[54] FOLDING MACHINES

[75] Inventors: Robert Yardley, Thurmaston; Ewen R. Cameron, Oadby; Frank H. Wolloff, Birstall, all of United Kingdom

[73] Assignee: Enhart Corporation, Hartford, Conn.

[21] Appl. No.: 621,361

[22] Filed: Jun. 14, 1984

[30] Foreign Application Priority Data

Jun. 22, 1983 [GB] United Kingdom ..... 8316899

[51] Int. Cl.[4] ..... A43D 11/00; D05B 27/00

[52] U.S. Cl. ..... 12/55.1; 12/55; 112/308

[58] Field of Search ..... 12/55, 55.1; 112/308, 112/309, 314, 315, 262.3; 223/38, 34, 37

[56] References Cited

U.S. PATENT DOCUMENTS

| | | | |
|---|---|---|---|
| 2,014,469 | 9/1935 | Coffey | 12/55 |
| 2,259,502 | 10/1941 | Topham et al. | 12/55 |
| 2,979,745 | 4/1961 | Schaefer, Jr. et al. | 12/55 |
| 3,051,476 | 8/1962 | Schaefer, Jr. | 12/55 |
| 3,080,836 | 3/1963 | Clemens et al. | 112/308 |
| 3,088,144 | 5/1963 | Weeks | 12/55.1 |
| 4,048,688 | 9/1977 | Crouch | 12/55.1 |
| 4,312,281 | 1/1982 | Doyen et al. | 112/309 |
| 4,312,286 | 1/1982 | Biotteau | 112/308 |
| 4,423,690 | 1/1984 | Willenbacher et al. | 112/308 |

*Primary Examiner*—Werner H. Schroeder
*Assistant Examiner*—Steven N. Meyers
*Attorney, Agent, or Firm*—William F. White

[57] ABSTRACT

A folding machine has workpiece sensing means including an emitter by which an "outside" corner in the workpiece edge approaching the operating locality of the machine can be sensed, such sensing causing the feed length by which the workpiece is advanced step-by-step through the operating locality to be reduced; this conventionally causes pleating in the folded over edge portion. In addition, delay means is provided by which, after the emitter has been re-covered by the workpiece, the feed length reduction continues for a given number of further feed steps.

5 Claims, 3 Drawing Figures

FOLDING MACHINES

BACKGROUND OF THE INVENTION

This invention is concerned with a folding machine comprising folding instrumentatlities for folding the edge of a workpiece fed therepast, workpiece feeding means by which a workpiece can be fed in a succession of feed steps to move the edge of the workpiece past the folding instrumentatlities, feed speed control means for controlling the speed at which the workpiece feeding means is caused to operate, feed length control means for controlling the length of each feed step of the workpiece feeding means, and workpiece sensing means by which, as a workpiece is fed as aforesaid, an "outside" corner (as herein defined) of the edge thereof approaching the folding instrumentalities is sensed, in response to which sensing the feed length control means is actuated to reduce the feed length independently of the speed at which the workpiece feeding means is operating the feedlength control means being thereafter de-actuated in response to said sensing means no longer sensing such "outside" corner.

The term ""outside" corner" where used herein with reference to a workpiece edge is intended to indicate a portion of the edge which is curved, wherein the radius passes through the area of the workpiece, while the term ""inside" corner", where used herein in relation to a workpiece edge, is intended to indicate a portion of the edge which is curved, the radius of curvature extending away from the workpiece. As is well-known, in folding an "outside" corner, because the area of the material to be folded over exceeds the area of material onto which it is folded, customarily pleating of the folded over portion takes place, while, in the case of an "inside" corner, because the area of the material to be folded over is less than that of the material onto which it is folded, the material to be folded over is snipped.

Conventionally, in such machines, the workpiece sensing means, which may be in the form of an emitter and sensor, e.g. an infra-red emitter and a corresponding receiver, customarily forms part of a number of workpiece sensing means by which also other functions of the machine can be controlled, e.g. adhesive "on" and "off", and these sensing means are usually arranged in an array "upstream" of the folding instrumentalities of the machine, each sensing means being actuated by sensing the position of a workpiece edge in relation thereto.

The positioning of the workpiece sensing means for sensing the approach of an "outside" corner is customarily determined so as to cause pleating to be initiated just before such corner arrives at the folding instrumentalities. In this way, the operator is able to steer the corner past the folding instrumentalities at a reduced feed rate, because of the reduced feed length.

In positioning the workpiece sensing means appropriately for initiating the pleating at the desired region of the workpiece edge, however, in some instances this may mean that, since the same workpiece sensing means is used for de-actuating the feed length control means, the pleating operation is curtailed before the corner has been fully moved past the folding instrumentalities.

In order to overcome this problem, in some machines the positioning of the workpiece sensing means is therefore a compromise between the requirements for actuation and those for de-actuation of the feed length control means.

OBJECT OF THE INVENTION

It is the object of the present invention to provide an improved folding machine in which the actuation and de-actuation of the feed length control means is achieved without the need for a compromise, while nevertheless enabling the whole of the corner to be adequately pleated.

SUMMARY OF THE INVENTION

The above object is achieved in accordance with the invention, in a machine as set out in the first paragraph above, by the provision of delay means whereby the de-actuation of the feed length control means as aforesaid is delayed for a pre-determined number of feed steps of the workpiece feeding means, following the sensing means no longer sensing such "outside" corner. In this way, it will be appreciated, the workpiece sensing means may now be positioned in an optimum manner for the actuation of the feed length control means, and any detrimental effect which this positioning would otherwise have had can be overcome by the operation of the delay means.

The pre-determined number of feed steps referred to may be a fixed number, but preferably in accordance with the invention operator-actuatable selector means is provided for selecting the pre-determined number of feed steps from a given range. By providing such operator-actuatable selector means, any idiosyncrasies in the operation of the machines as between different operators can be accommodated, and in general it is expected that a range of 0 to 4 steps will be adequate for this purpose.

In addition, conveniently the selector means may include an "off" condition in which, when selected, the feed length control means is not actuated as aforesaid in response to an "outside" corner in the workpiece edge approaching the folding instrumentalities.

For controlling the delay means as aforesaid any suitable means may be used, e.g. a mechanical counter arrangement, but preferably in accordance with the invention of the control of the operation of the delay means is by an electronic circuit including a computer, e.g. a microprocessor.

BRIEF DESCRIPTION OF THE DRAWINGS

The above and other features of the invention will now be described with reference to the accompanying drawings, in which.

DESCRIPTION OF THE PREFERRED EMBODIMENT

Figure 1:
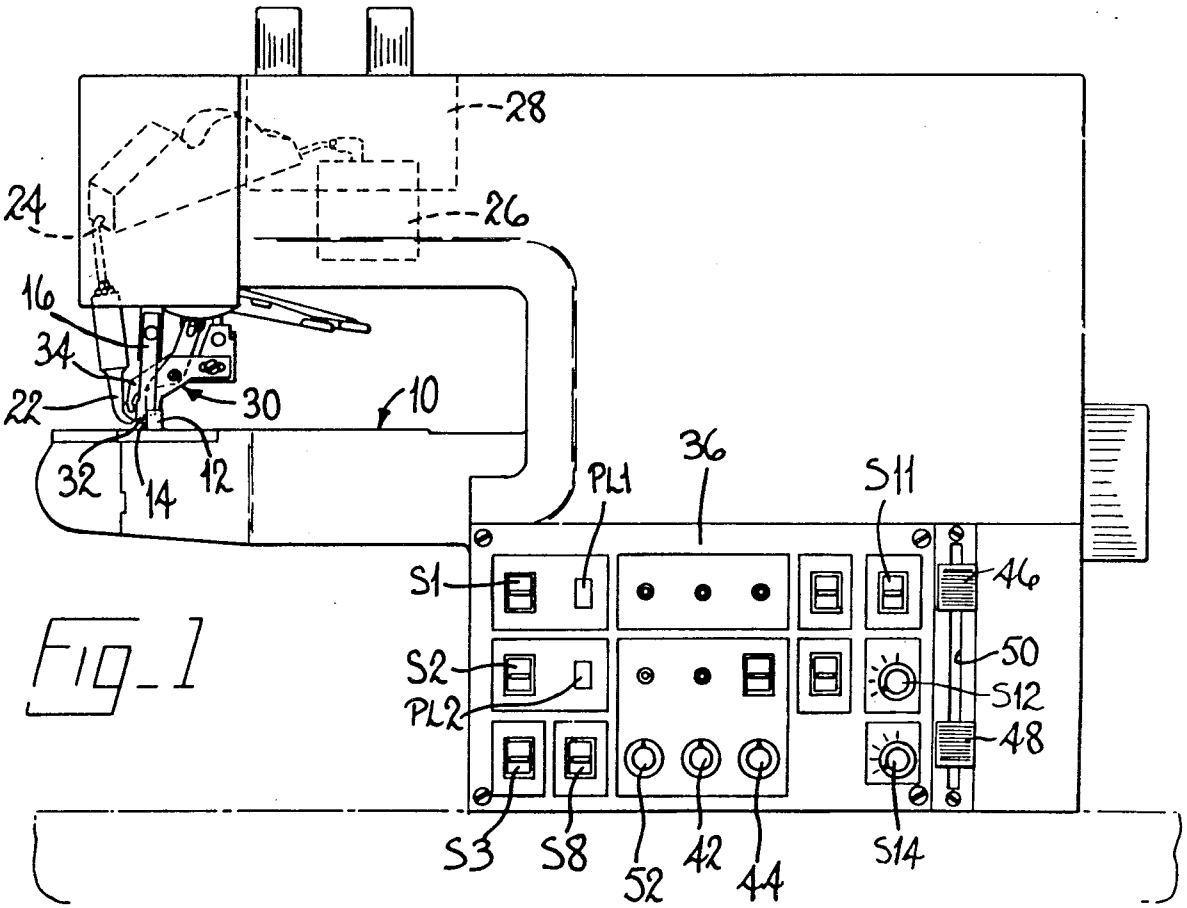
FIG. 1 is a front view of the machine now to be described.

The machine now to be described is a so-called thermo-cementing and folding machine, which finds use in the shoe industry and allied trades. This machine is itself a modification of the machine described in commonly assigned U.S. patent application No. 554,558, filed Nov. 23, 1983. The machine thus comprises a work table 10 on which a workpiece can be supported at an operating locality of the machine, at which conventional folding instrumentatlities are located, comprising a fold-initiating block 12 having an upwardly curved work-guiding surface 14, a guage finger 16, a creaser foot 22 and a lip turner (not shown), which completes the fold of the workpiece edge over the creaser foot. During folding, adhesive can be applied to the workpiece edge through an outlet in the creaser foot, to which adhesive is supplied via a delivery tube 24 from a melt chamber 28 under the action of a gear pump 26. The melt chamber 28, delivery tube 24 and creaser foot 22 are heated respectively by heaters H1, H2, H3. Other features of the folding instrumentalities are shown in FIG. 1.

"Downstream" of the folding instrumentalities are located conventional edge snipping means generally designated 30, comprising a fixed and movable blade 32, 34, and conventional workpiece feeding means in the form of an orbitally moving hammer-and-anvil arrangement (now shown), which also serves to consolidate the fold. A work release clamp (not shown)is also provided for clamping the work against the under-side of the creaser foot during the return movement of the hammer-and-anvil arrangement.

A control panel 36 of the machine (FIG. 1) as a "mains on/off" switch S1 with associated pilot lamps PL1, a "motor on/off" switch S2 with associated pilot light PL2, a "work lamp on/off" switch S3, a control knob 42 by which the operator can set the operating speed of a motor M, driving the gear pump 26 in relation to the main motor speed, a further control knob 44 by which the operator can control the amount of so-called adhesive suck-back at the end of an operating cycle of the machine, and a control knob 52 by which the operator can control the heater H3, and thus the temperature of the creaser foot 22.

For controlling the operation of the gear pump 26, workpiece sensing means, including two emitters E1, E2, is provided which serve to sense the presence of a workpiece at the operating locality of the machine upon being covered thereby and thus signalling a drive SMD for the gear pump 26, which is conveniently driven by a stepping motor M. In addition, a switch S11 is provided on the control panel 36 for selecting which of the two emitters E1, E2 is to be effective in switching off the motor M at the end of an operating cycle.

For controlling the operation of the edge snipping means 30, work sensing means constituted by for emitters E3, E4, E5, E6 is provided which, upon being covered by an "inside" corner (as herinbefore defined) of a workpiece edge approaching the operating locality is effective to cause a solenoid SOL2 to be energized, whereby the edge snipping means 30 is actuated. A switch S12 is provided on the control panel 36 for selecting which of the four emitters is to be operational in an operating cycle; this switch also has an "off" position, whereby all the emitters are disabled. In this latter case, of course, no edge snipping will take place in the operation of the machine.

The hammer-and-anvil arrangement of the machine in accordance with the invention is driven through a main drive shaft (not shown) by means of an electric motor (not shown) operating through a clutch. The motor speed, and thus the workpiece feed speed, is controlled by the operator, using a treadle (not shown). In addition, the distance through which the hammer-and-anvil arrangement moves during a workpiece feeding step thereof can be varied, thus to vary the so-called "feed length", the arrangement being such that a reduced feed length is effective to cause the folded over portion of the workpiece edge to be pleated. For controlling the feed length, "maximum" and "minimum" stops 46, 48 are provided, projecting through a slot 50 in the control panel 36. The operator can thus set the stops 46,48 according to the nature of the contour of the workpiece edge. The means for controlling the hammer-and-anvil arrangement as aforementioned and the provision of stops are conventional in thermo-cementing and folding machines.

For switching between the "maximum" and "minimum" settings for the feed length, workpiece sensing means, constituted by an emitter E7, is provided which in response to being uncovered by an "outside" corner (as herinbefore defined) in the workpiece edge approaching the operating locality of the machine, causes solenoid SOL1 to be energized, whereupon the minimum feed length is selected, subsequent de-energizing of solenoid SOL1 being effective to return the feed length to its maximum setting.

In addition, in some instances it may be desired to select a reduced feed length when the edge snipping means 30 is actuated. To this end, switch S8 is also provided on the control panel, which serves, upon sensing of an "inside" corner in the workpiece edge approaching the operating locality, to energize both solenoids SOL1, SOL2.

Also on the control panel 36 is a six-position selector switch S14 (constituting operator-actuatable selector means of the machine) by which the operator can switch off solenoid SOL1, thereby preventing short feed (pleating) from taking place in response to the uncovering of emitter E7, or can select one of five positions whereby 0 to 4 further steps of reduced feed length respectively can take place after the emitter E7 has been re-covered by a workpiece; the circuitry by which this facility is provided constitutes delay means of the machine.

Figure 2:
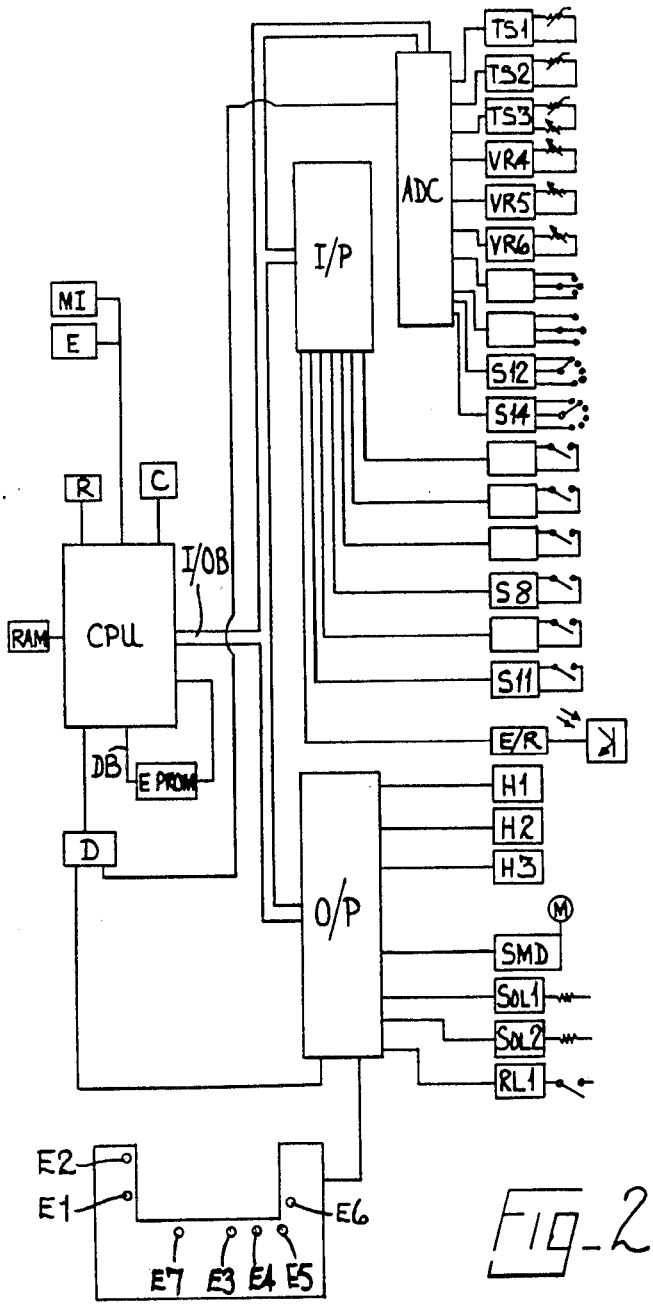
FIG. 2 is a block diagram of an electronic control circuit of said machine.

The emitters E1 to E7 referred to above are arranged in an array (as shown schematically in FIG. 2) just "upstream" of the operating locality. Co-operating with the emitters E1 to E7, furthermore, is a receiver E/R which senses whether an emitter is covered by a workpiece or not so that the presence or absense of a workpiece at the operating locality and the approach of "inside" and "outside" corner to the operating locality can be sensed.

In the machine in accordance with the invention, when switch S1 is switched on, mains power is supplied to solenoids SOL1, SOL2, to heaters H1, H2 and also to a transformer (not shown) which steps down the voltage to 12 volts. The 12 V a.c. supply from the transformer is supplied to a work lamp circuit, which includes the switch S3, and to the heater H3. In addition, from this circuit is derived an unsmoothed 12 volt d.c. circuit which supplies power to a mains-controlled control box MI supplying a "mains interrupt" signal to be referred to hereinafter. In addition, there is derived from the 12 V a.c. circuit a smoothed 12 V d.c. circuit which supplies power to the motor M (which is constituted by an n.c. motor, e.g. a stepping motor). From the smoothed 12 V d.c. circuit, furthermore, is derived a 5 V circuit, which drives a central processor unit CPU and associated circuits, and supplies power to switches S4 to S12, thermisters TS1, TS2, TS3 and potentiometers VR4, VR5 and VR6, each of which will be referred to hereinafter.

The central processor unit CPU, which controls the machine, is constituted by a single-chip, 8-bit microcomputer (in casu, a Zilog Z8681 which, in addition to a microprocessor, also incorporates a random access memory/scratch pad RAM (shown separately in FIG. 2); this microprocessor is obtainable from Zilog, Inc.). For the internal timing of the CPU a system clock C, comprising a free-running 8 MHZ crystal, is provided. The CPU is connected via input-output bus I/OB with input and output ports IP, OP and via a memory address and data bus DB with a non-volatile memory in the form of an EPROM (erasable programmable read-only memory), which is accessed by the CPU via the data bus DB for instructions to execute. A conventional decoder D is also provided for controlling the functioning of the input and output ports IP, OP. In addition, an analogue-to digital convertor ADC is provided, to which signals are supplied by the potentiometers VR4, VR5, VR6, thermisters TS1, TS2, TS3, and switches S10, S12 and S14. The ADC is interrogated by the CPU, via the I/O bus, each time a mains interrupt signal is supplied to the CPU by the control box MI. More particularly, the various channels of the ADC are interrogated in turn, one in response to each mains interrupt in a so-called "wrap around" sequence. The ADC, in response to a signal from the decoder D, supplies information as to the state of the interrogated channel via the input port IP. Switch S8 supplies information via the input port in response to an enabling signal from the decoder D. The control circuit also comprises a re-set sub-circuit R which is directly connected into the CPU and by which, upon starting up of the machine, the CPU is enabled to set the controls to their correct state in a rapid manner. A shaft encoder E driven by the main drive shaft is also provided having a direct "interrupt" input to the CPU.

In response to the various signals thus supplied to the CPU, the CPU supplies outputs, via output port OP, to sub-circuits controlling the heaters H1, H2, H3, the solenoids SOL1, SOL2, drive SMD, emitters E1 to E7, various LEDs and relay RL1. This relay serves as a "watch dog" over the whole of the control circuit. To this end, it is maintained in a "made" condition during normal operation of the machine by a control sub-circuit which is "refreshed" at regular intervals, failure to refresh the sub-circuit causing the relay RL1 to drop out. More particularly, the sub-circuit receives a signal at each mains interrupt, the signal serving to change the state of the circuit between "1" and "0", the arrangement being such that switching to the "1" state constituting the "refresh" signal. The sub-circuit is arranged to become de-energized, in the absence of a refresh signal, after a time interval which is greater than the interval between two "1" signals. De-energization of the sub-circuit of course switches off the relay, thereby terminating the power supply to the machine.

In the machine in accordance with the invention the emitters, constituting the various sensing means, are actuated in response to control pulses supplied by the CPU sequentially thereto at each system clock interrupt and emit pulses of infra-red radiation, which are separately received by the receiver E/R located in the machine head above the emitters. In other machines in accordance with the invention other types of sensing means may of course be utilized.

Thermisters TS1 to TS3, referred to above, serve to sense the temperature of respectively the melt chamber 28, delivery tube 24 and creaser foot 22 and thus, through the CPU, to control the output of the heaters H1, H2, H3 respectively. Poteniometers VR4 to VR6 are controlled respectively by the control knobs 42, 44, 52 and provide appropriate signals through the ADC in accordance with the settings of those control knobs.

Figure 3:
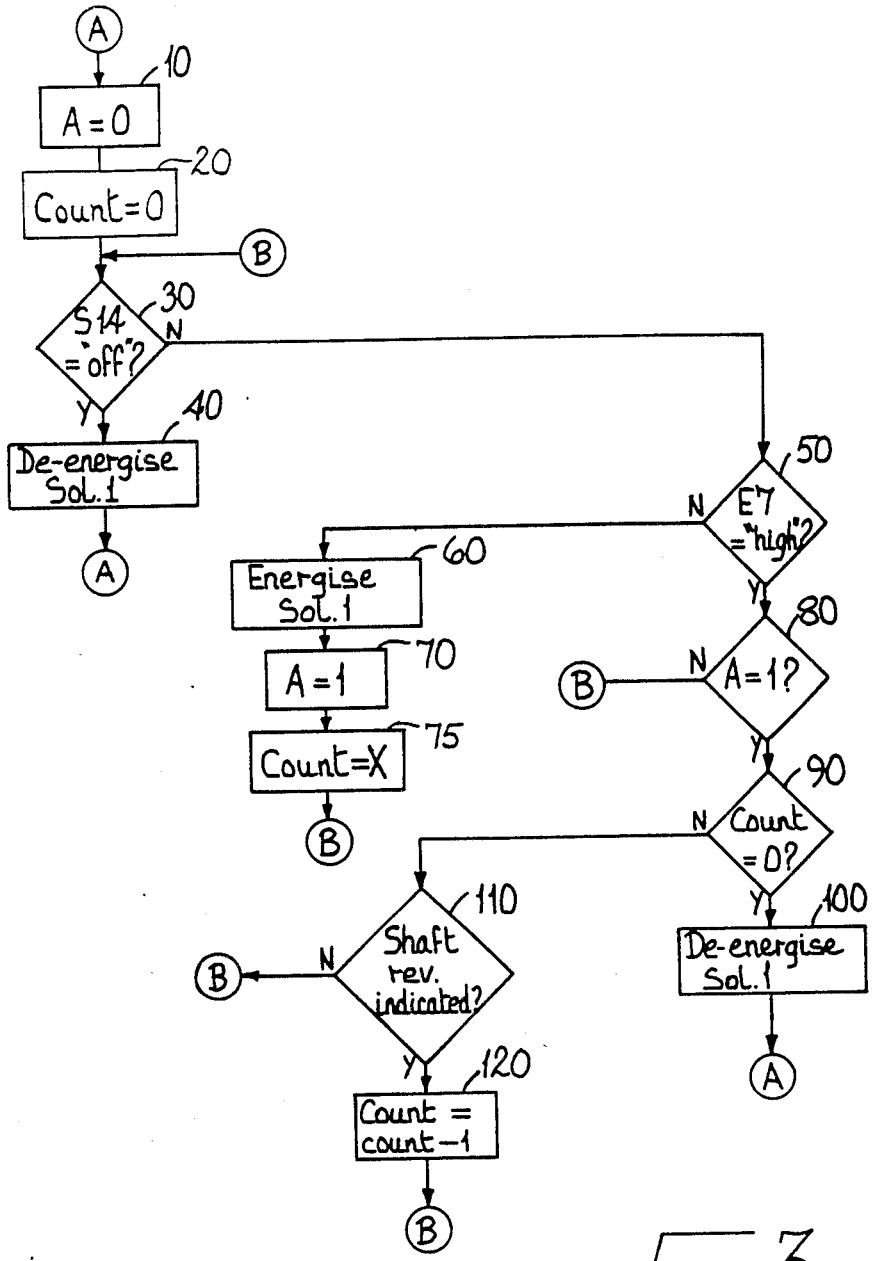
FIG. 3 represents part of the computer software by which the machine operation is controlled.

FIG. 3 is a flow chart of the software by which the operation of the delay means is controlled. The script within each box is a shorthand reference to the command or inquiry being made; a full description of each step is appended to this specification.

From FIG. 3 it will be seen that, with switch S14 switched to select a given delay (constituted by a further number of pleat steps (X)) (step 75), the covering of emitter E7 after it has previously been uncovered initiates a count-down (steps 90,110,120) from X to 0, whereupon solenoid SOL1 is de-energized. It will be appreciated that step 110 requires counting interrupt pulses from the shaft encoder and noting each time a full revolution of the main drive shaft has been executed.

APPENDIX

| | |
|---|---|
| 10 | Set Flag A = 0 |
| 20 | Set Count = 0 |
| 30 | Is 6-position switch S14 in "off" position - indicating no pleating required? |
| 40 | De-actuate solenoid SOL1 - to disable pleating. |
| 50 | Is emitter E7 covered - indicating no "outside" corner sensed? |
| 60 | Actuate solenoid SOL1 - initiating pleating. |
| 70 | Set Flag A = 1 |
| 75 | Set Count = the number of pleat steps required after emitter E7 is re-covered (X), as set by switch S14. |
| 80 | Does Flag A = 1? |
| 90 | Does Count = 0? |
| 100 | De-actuate SOL1 - to disable pleating. |
| 110 | Has encoder E indicated a complete revolution of main drive shaft? |
| 120 | Let Count = Count − 1 |

It is to be appreciated from the above that a description of the preferred embodiment of the invention has been given. This embodiment may change without departing from the scope of the present invention. For instance, it will be appreciated that the machine which has been selected is merely by way of exemplification and not by way of limitation of the invention.

What is claimed is:

1. A folding machine comprising folding instrumentalities for folding the edge of a workpiece fed therepast, workpiece feeding means by which a workpiece can be fed in a succession of feed steps to move the edge of the workpiece past the folding instrumentalities, feed speed control means for controlling the speed at which the workpiece feeding means is caused to operate, feed length control means for controlling the length of each feed step of the workpiece feeding means, workpiece sensing means for sensing an "outside" corner of the edge of the workpiece when the same approaches said folding instrumentalities whereby said feed length control means is actuated in response thereto so as to reduce the feed length independently of the speed at which the workpiece feeding means is operating, the feed length control means being thereafter de-actuated in response to said sensing means no longer sensing such "outside" corner, and delay means for delaying the de-actuation of the feed length control means as aforesaid for a pre-determined number of feed steps of the workpiece feeding means, following the sensing means no longer sensing such "outside" corner.

2. Machine according to claim 1 comprising operator-actuatable selector means for selecting said predetermined number of feed steps from a given range.

3. Machine according to claim 2 wherein the given range is 0 to 4.

4. Machine according to either one of the claims 2 and 3 wherein the selector means includes an "off" condition in which, when selected, the feed length control means is not actuated as aforesaid in response to an "outside" corner in the workpiece edge approaching the folding instrumentalities.

5. Machine according to claim 1 wherein the operation of the delay means is computer-controlled.

* * * * *